US005655943A

United States Patent [19]

Dahlgren

[11] Patent Number: 5,655,943

[45] Date of Patent: Aug. 12, 1997

[54] PADDLE WHEEL FOR MOVING STREAM IN A WATER ACTIVITY TOY

[75] Inventor: Lannart Dahlgren, Askim, Sweden

[73] Assignee: Aquaplay AB, Sweden

[21] Appl. No.: 571,489

[22] Filed: Dec. 13, 1995

[51] Int. Cl.[6] ..... A63H 23/00

[52] U.S. Cl. ..... 446/153; 446/159; 446/246; 446/429; 472/13; 472/128; 416/197 R

[58] Field of Search ..... 446/153, 155, 446/176, 199, 201, 267, 429, 236, 246, 89, 159; 472/13, 117, 128; 416/197 R; 366/325.7, 325.8, 325.94

[56] References Cited

U.S. PATENT DOCUMENTS

| | | | |
|---|---|---|---|
| 54,123 | 4/1866 | Cushman | 416/197 |
| 537,582 | 4/1895 | Poole | 416/197 |
| 930,613 | 8/1909 | Pressey | 446/153 |
| 1,372,834 | 3/1921 | Schmelzer | 416/197 |
| 1,533,493 | 4/1925 | Baty | 446/159 |
| 1,580,046 | 4/1926 | Jones . | |
| 1,624,282 | 4/1927 | Russell . | |
| 2,604,055 | 7/1952 | Snowden . | |
| 4,429,867 | 2/1984 | Barber . | |
| 4,963,116 | 10/1990 | Huber | 446/153 |

FOREIGN PATENT DOCUMENTS

| | | | |
|---|---|---|---|
| 909382 | 5/1946 | France | 446/153 |

*Primary Examiner*—Robert A. Hafer
*Assistant Examiner*—Jeffrey D. Carlson
*Attorney, Agent, or Firm*—Ostrolenk, Faber, Gerb & Soffen, LLP

[57] ABSTRACT

A water activity toy with a channel for a stream of water which floats a vessel on the stream. A paddle wheel moves through the water to move the stream. The paddle wheel includes a plurality of blades all on axle stub portions at supports at opposite sides of the channel. Each blade could be above the channel when a vessel floats by. The blade is curved downward around an axis extending from the base edge to the free edge of the blade so that with two oppositely directed blades both oriented to extend along the channel, the middle of the blade would be higher off the water in the channel than the regions of the blades at the axle portions. Each blade also has a cutout at its base edge so that if the blade were oriented upright, the base edge of the blade would be higher off the water in the channel toward the middle of the blade than at the axle portions. A crank used to rotate the paddle wheel is connected with the axle stub portion that is raisable out of the support that holds that axle stub portion, and raising the crank lifts the paddle wheel.

11 Claims, 5 Drawing Sheets

PADDLE WHEEL FOR MOVING STREAM IN A WATER ACTIVITY TOY

BACKGROUND OF THE INVENTION

The present invention relates to a water activity toy, particularly a toy with a water flow pathway, and more particularly to a paddle wheel for moving a stream of water through a water pathway of the toy.

To move a water stream along a pathway, the activity toy may include a paddle wheel which pushes the water. A floating vessel, like a boat, may be moved by the stream generated by the paddle wheel.

The pathway of the stream is defined by a water container that defines a channel through which the water stream is to be pushed. In a typical water activity toy, the container defines an endless loop channel along a perhaps circular, oval or otherwise interestingly shaped path.

The paddle wheel typically includes several blades supported on an axle which rotates the blades through and along the channel to push the water stream. The axle may be supported on opposite sides of the channel. Paddle wheel rotation means, for example, a manually operable crank, is connected with the axle.

The paddle wheel blades, and perhaps the entire paddle wheel, extend far enough down into the channel to serve as an obstacle to the movement of a floating vessel past the wheel. Possibilities for avoiding interference with the vessel moving along the channel past the paddle wheel are to raise the wheel and blades out of the channel while the vessel floats past, possibly moved by the force of the moving stream or because it is pushed, and/or to shape the paddle wheel or its blades so that the paddle wheel will not interfere with passage of the vessel.

In one existing paddle wheel design, the paddle wheel is supported at supports at both sides of the channel, and is swingably supported at one side of the channel so that the paddle wheel can be tilted up out of the channel e.g. to permit a floating vessel to pass. To reduce the extent to which the paddle wheel must be tilted and to minimize interference with the vessel, the blades may be arrayed non-uniformly spaced around the paddle wheel, leaving a large gap angular space around the paddle wheel which can be positioned over the channel when the vessel moves past and reducing the bulk of the paddle wheel which might interfere with passage of the boat. However, the known paddle wheel still interferes with a vessel moving along the channel and additionally is complicated for a young child, for whom the invention is particularly adapted, to operate.

SUMMARY OF THE INVENTION

Accordingly, it is the primary object of the present invention to provide a paddle wheel for a water activity toy for moving a stream of water through a channel.

Another object of the invention is to provide such a paddle wheel which reduces interference to passage of a vessel floating on the stream through the channel past the wheel.

A further object of the invention is to provide such a paddle wheel which is easily moved out of a position obstructing passage of a tall vessel through the channel, wherein the shaping of the paddle wheel is not alone sufficient to prevent obstruction of the vessel floating past the paddle wheel.

The water paddling means referred to herein is a paddle wheel. According to the invention, the paddle wheel has at least one and preferably a plurality of paddle blades on it. The paddle wheel may include as few as one blade, preferably includes at least two blades, most preferably includes three blades, but usually includes fewer blades than what might be considered sufficient to define a "wheel". All of the blades are supported on a single rotation axle having axle stub portions located at each side of the channel. A crank attached to one of the axle portions is rotated to rotate the wheel. Automatic means may be substituted for the manual crank.

The root or base edge of each blade does not extend on a straight line between the axle portions at the opposite sides of the channel, but rather is shaped so that with the paddle wheel held at a selected rotated orientation, the bottom of the paddle wheel at the base edge of each blade is perhaps higher above the water in the channel or not lower toward the water than the edge of the blade in the axial regions near the axle portions. For example, each blade may be shaped so that its base edge is rounded or curved upward away from the axle portions, so that with the paddle wheel held at a particular rotation orientation, the base edges of the blades are high enough over the water in the channel to provide greater clearance for a vessel to travel along the channel. As an alternative to the round shaping, the base edge of the blade may be cut out in a triangular or a rectangular cut out.

The number and placement of the blades around the paddle wheel is such that at at least one orientation of the paddle wheel, the outer or free edges of each of the blades are at least as high as or perhaps even higher than the roots or bottom edges of all of the blades, so that the blades will not interfere with the passage of a vessel along the channel. For example, viewed from the side of the channel, the blades may incline up from the roots of the blades, so that the roots of the blade are at the lowest height. In any event, the free edges of the blades are not lower toward the water than their base edges.

Further, the blades are held lowest over the channel at a selected rotation orientation of the wheel. Those blades need not be flat or planar across the channel, but are preferably curved, so that with the paddle wheel at an orientation where the lowermost blades generally extend along the direction of the channel, each of the lowest height blades is higher above the water at its center across the channel than at the axle portions at the sides of the channel, i.e. the blade is curved around an axis extending from the root or base edge to the free edge of the blade, with the curve upward above the channel, creating a path beneath the center of the blade and between the base edge and the free edge for a vessel to pass the blade.

The axle stub portions are held to be able to rotate in supports or fixtures at the opposite sides of the channel. One of the fixtures includes a swing connection for one axle stub portion which permits the entire paddle wheel to be pivoted up above the channel. The other axle stub portion is supported in a slot in the other fixture and the axle may be lifted out of that slot. The crank handle for rotating the paddle wheel is preferably connected at the axle stub portion in the slot, so that a young child can simply lift the paddle wheel above the channel by raising the crank.

Other objects and features of the present invention will become apparent from the following description of a preferred embodiment considered in conjunction with the accompanying drawings.

DESCRIPTION OF THE PREFERRED EMBODIMENT AND THE PRIOR ART EMBODIMENT

Figure 1:
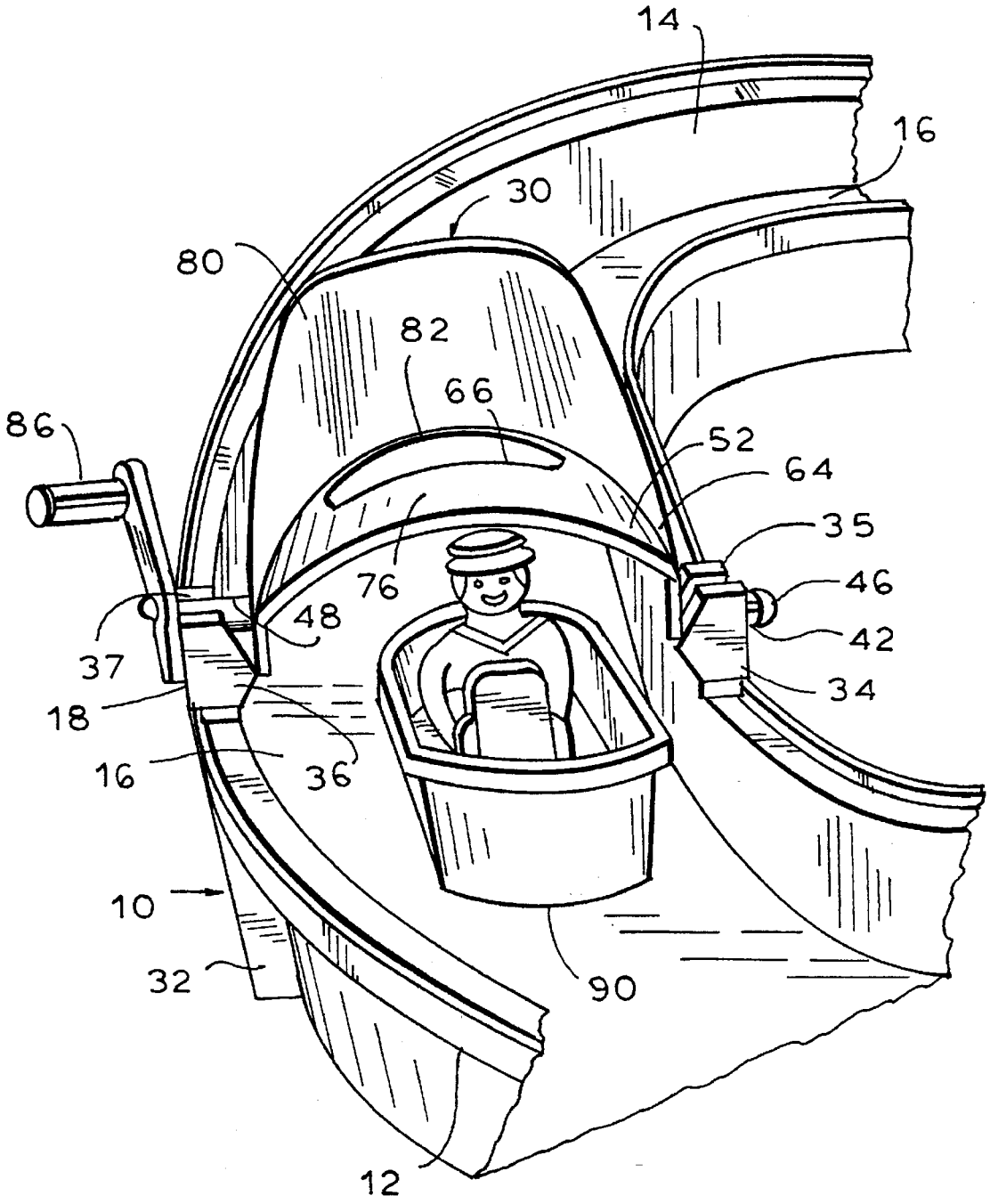
FIG. 1 shows a portion of a water toy with a paddle wheel according to the present invention in a first orientation.

Referring to FIG. 1, the water activity toy 10 comprises a closed circuit tank 12 including a narrow endless loop channel 14 which is partially filled with a water stream 16 when the toy is to be used. The path of the channel is not significant. It can be circular, oval, rectangular or any other shape. Only a part of the tank and channel are shown here. Significant here is that the channel 14 includes a channel section 18 at which the water impeller paddle wheel 30 according to the invention is disposed for moving the water to provide a moving stream 16. A toy boat 20 or other floating vessel rides on the stream as the water is pushed through the channel 14.

Figure 2:
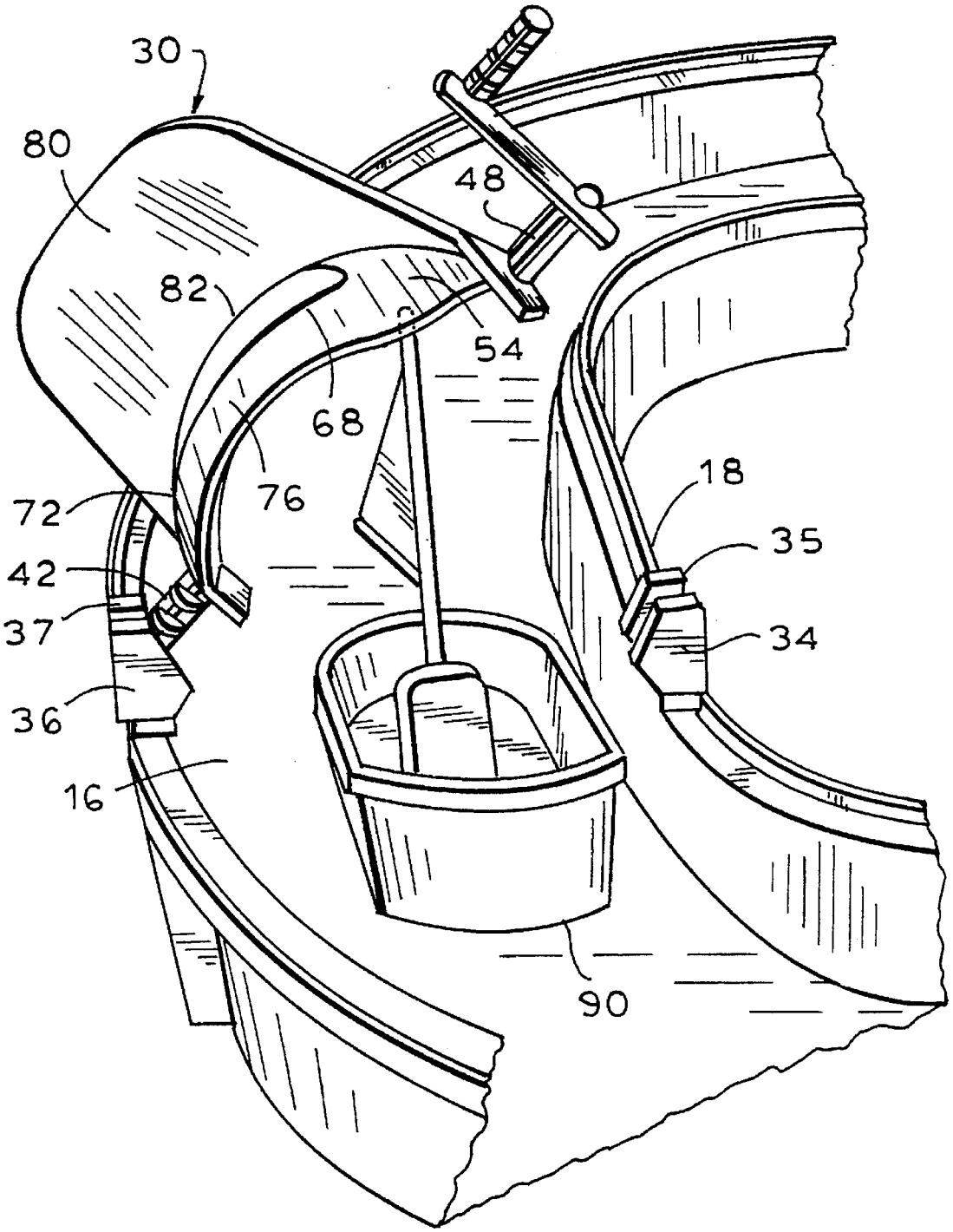
FIG. 2 shows the toy with the paddle wheel in a second orientation, wherein it is both installed in the opposite direction and is tilted up.

The paddle wheel 30 is supported by a support bracket 32, which wraps the tank 12 on the outside. The bracket has a first support 34 including a slot 35 at one side wall of the channel section 18 and a second support 36 which has a slot 37 at the opposite side wall of the channel section 18. The slots 35 and 37 are essentially of the same design. This enables the paddle wheel 30 to be installed with the crank 86 either inward or outward of the channel, as seen in FIGS. 1 and 2. Each of the supports 34 and 36 is formed to function as a hinge which permits upward tilting of paddle wheel 30 to provide clearance for a tall mast 54 (FIG. 2), as will be explained.

Figures 3, 4, 5:
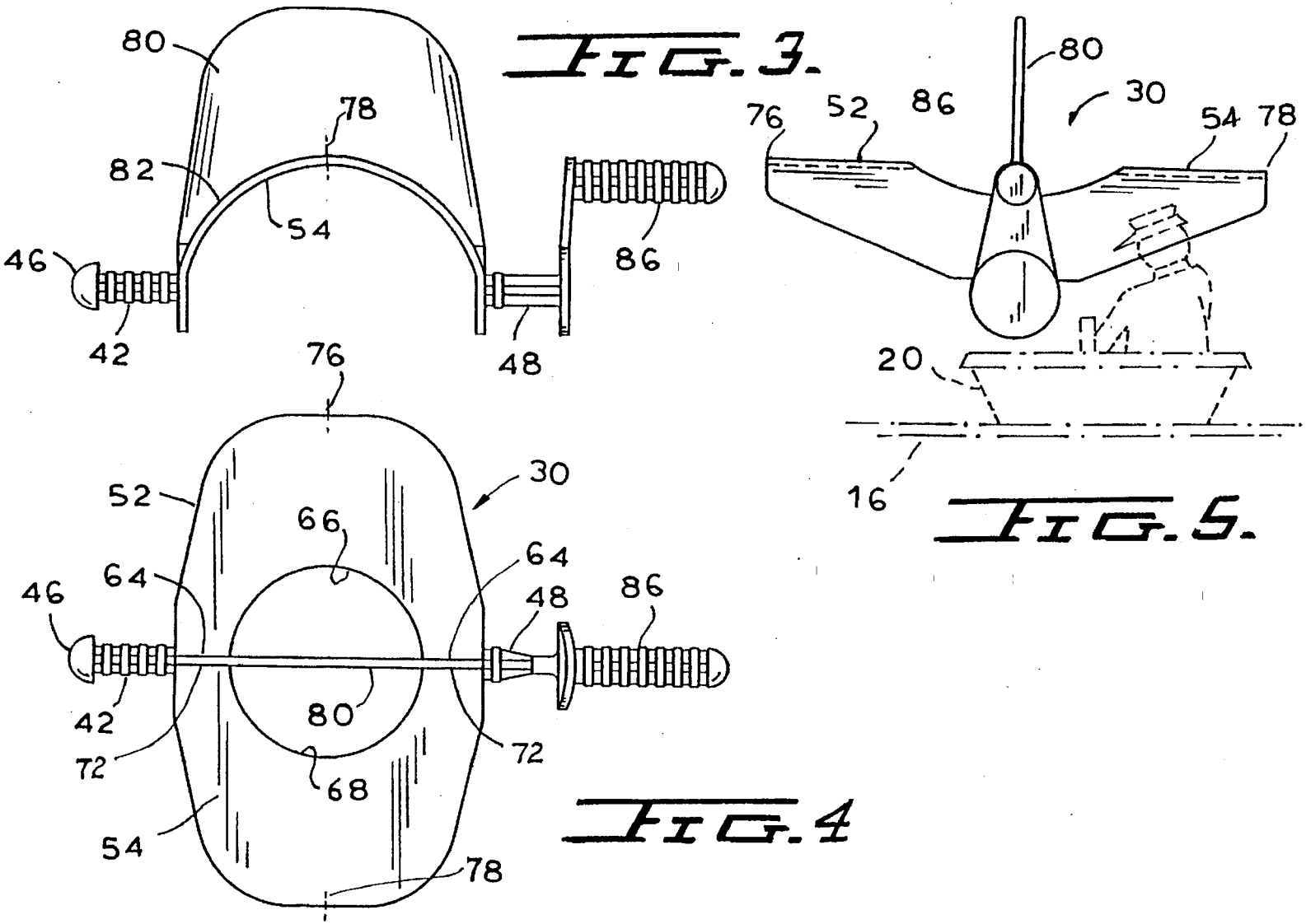
FIG. 3 is an end view of the paddle wheel.
FIG. 4 is a plan view of the paddle wheel.
FIG. 5 is a side view of the paddle wheel.

With reference to FIGS. 3 and 4, the paddle wheel 30 includes an axle stub portion 42 at one side, which in the orientation of FIG. 1 is received in the slot 35 of the support 34, which enables the paddle wheel 30 including the axle stub portion 42 to rotate. Each slot 35 and 37 includes a narrowed region which captures the enlargement 46 at the end of the axle stub portion 42, so that the axle stub portion 42 can be tilted and swung while remaining in the respective slot 35 or 37, as shown in FIGS. 1 and 2.

The axle stub portion 48 at the opposite side of the paddle wheel 30 is received in the respective slot 37 in the support 36 in the orientation of FIG. 1. The axle stub portion 48 is shaped to be easily moved into and out of the slot 37 so that the paddle wheel 30 may be tilted up or down, as shown in a comparison of FIGS. 1 and 2. If the paddle wheel is installed with the crank inward, as in FIG. 2, rather than outward, as in FIG. 1, then the axle stub portion 42 is received in the slot 37 while the axle stub portion 48 is received in the slot 35.

Extending between and connected to both axle stub portions 42 and 48 are the three paddle blades 52, 54 and 80 with unique shape characteristics. The blades are so positioned around the wheel 30 that with the wheel and blades at one selected rotation orientation shown in FIGS. 1, 3 and 5, none of the blades projects down into the channel 14 and the then lowest blade or blades generally extend along the channel section 18.

The three blades are each at a 90° angle to the adjacent blade, without any blade being located over a 180° gap space to the bottom in FIGS. 3 and 5. As shown in FIG. 5, the two lower blades 52 and 54 may be oriented to extend off generally in opposite directions so that they can extend parallel to the water stream 16. They may also be oriented to define a generally slightly "v" shape with an angle slightly less than 180° between them, that is, in one rotative orientation of the paddle wheel 30, the blades 52 and 54 are lowest toward the water stream 16 at the axle stub portions of the blades, that is lower at their roots or base edges, and higher above the water at their outer or free edges.

The root or base edge of the blade 52 does not extend straight across the blade 52 between axle stub portions 42 and 48. Rather, in the axial side regions near the axle stub portions, the blade 52 includes base portions 64 which are at the axle stub portions. Then inward from both axle stub portions, the base edge includes a rounded cutout region 66, so that the root or base edge of the blade is elevated above the stub axle portions. The blade 54 also has a rounded cutout region 68 between its side regions 72 at the axle stub portions.

Each blade 52 and 54 is curved around an axis extending from the base edge to the opposite free edge of the blade, and when the blade is oriented to extend along the channel, as in FIGS. 1, 3 and 5, the blade is curved down toward the axle stub portions around an axis extending along the length of the channel section 18. As a result of the cutouts 66 and 68 into the bases of the blades and the curvatures of the blades around an axis, the blades 52 and 54 have their highest elevation at their centers 76 across the channel while each blade is lowest in height toward the axle stub portions 42 and 48. This permits the toy boat 20 and any toy occupant in or any projection up from the boat to pass beneath the blades 52 and 54 without contacting the blades, even though the axle stub portions 42, 48 for the blade are lower in height.

A third generally planar blade 80 may also be attached at the axle stub portions. The blade 80 has the same cutout root or bottom edge as the blades 52 and 54. However, the blade 80 need not be curved around an axis extending along the length dimension of the blade, since with the blades 52 and 54 oriented as in FIGS. 1 and 5 to permit the boat 20 to pass beneath them, the blade 80 extends up and is not in a position to obstruct passage of the boat.

The paddle wheel 30 includes a manual crank 86 attached to the axle stub portion 48 for rotating the wheel 30.

To raise the paddle wheel 30 out of the way of a vessel passing by the wheel in the channel, and without completely removing the paddle wheel 30 from the tank 12, the crank 86 is lifted, which raises the entire paddle wheel 30 around the swing axis provided at the axle stub portion 42, 46 and the slot 35 in FIG. 1 or 37 in FIG. 2. With the paddle wheel 30 lifted out of and above the channel section 18, to the orientation shown in FIG. 2, a taller floating vessel, like the toy boat 90 with a sail, can pass beneath the paddle wheel 30.

In order to keep the water stream 16 flowing and the boat moving through the channel 14, 18, the paddle wheel 30 is rotated to move the water 16 through the channel 14 before the boat 90 passes the channel section 18, is lifted to the orientation shown in FIG. 2, to permit the boat to be moved past by the continuing inertial flow of water, and is then lowered again to its position of FIG. 1, and its continues rotation moves the water through the channel 14.

Figure 6:
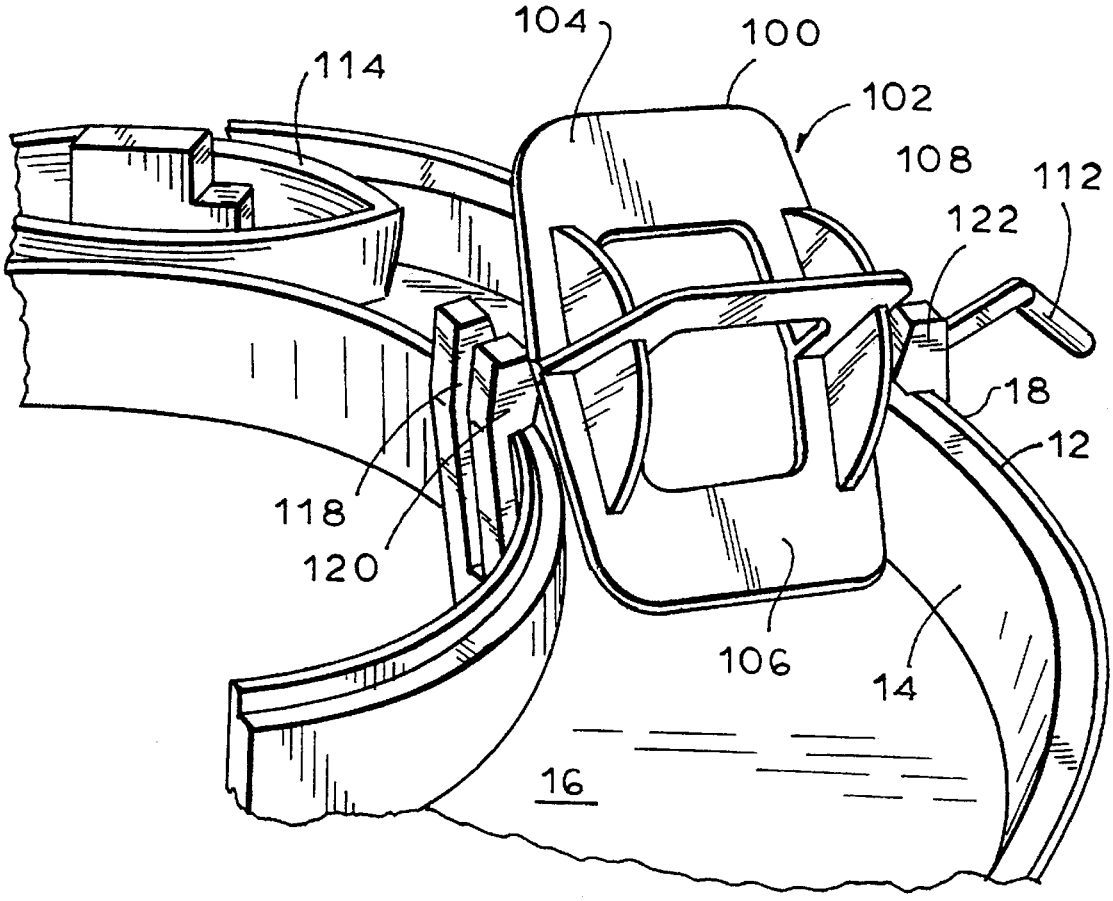
FIG. 6. PRIOR ART
FIG. 6 is a perspective view of a water toy with a prior art paddle wheel in the first orientation.
Figure 7:
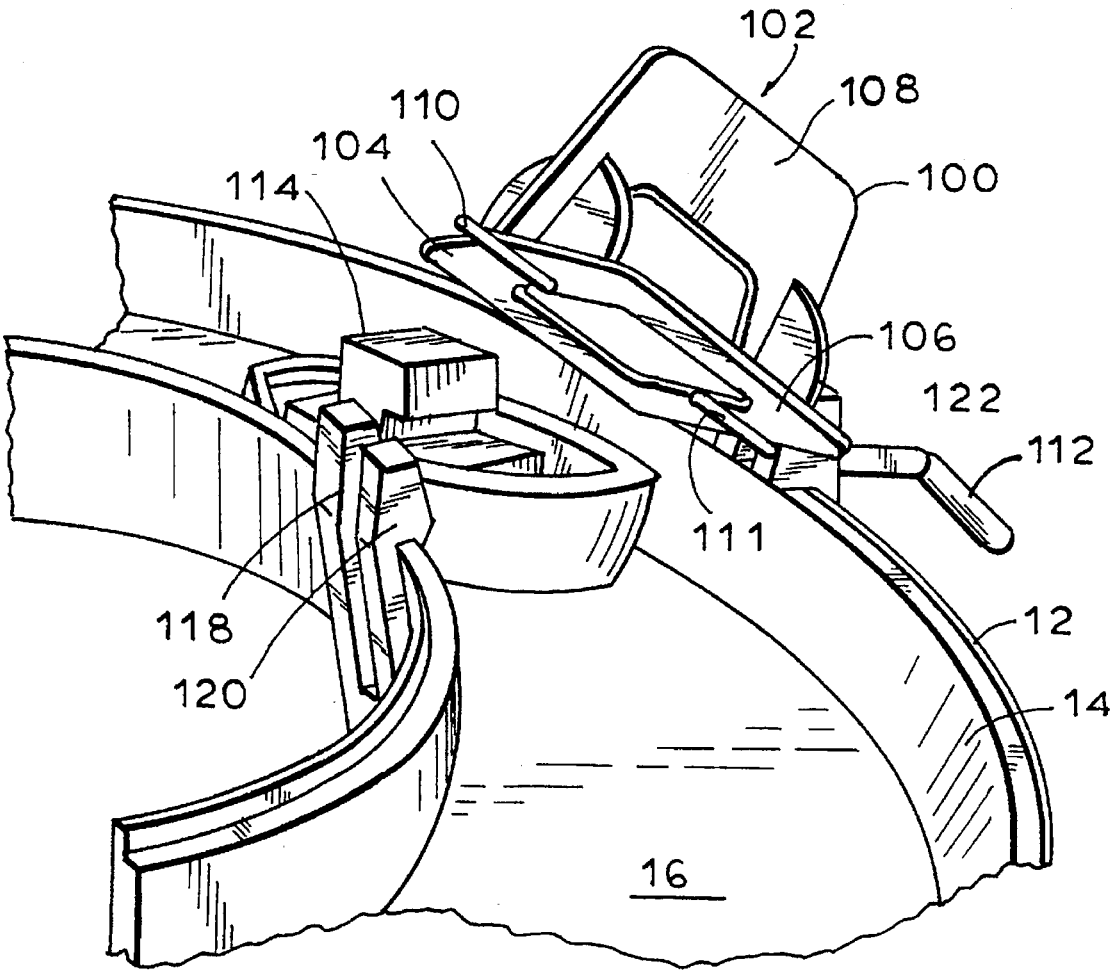
FIG. 7. PRIOR ART
FIG. 7 is a view of the toy with the same prior art paddle wheel in a second orientation.

A prior art paddle wheel 100 for the same channel 14, 18 is illustrated in FIGS. 6 and 7. The paddle wheel 100 has three blades 104, 106 and 108 which project from the axle stub portions 110, 111 of the wheel 100 in three mutually perpendicular directions. The crank 112 connected to a common axle stub portion 111 for all of the blades can rotate the wheel to an orientation, as in FIG. 7, where none of the blades projects downward into the channel. But this does not raise the heights of the bottom edges of the blades or of the bodies of the blades enough that they cannot obstruct the boat 114 floating along the channel. When the bottom blades 104 and 106 are flat and project in opposite directions, rather than being rounded as blades 52, 54, it is necessary to tilt up the prior art paddle wheel 100 for almost every boat 114 that passes by no matter how short it is.

In the prior art paddle wheel, one rotatable axle stub portion 110 is received in the slot 118 of the fastener and support 120 which defines a rotation bearing, and the axle stub portion 110 may be raised out of or lowered into the slot 118. The other axle stub portion 111 is held in the corresponding slot formed in the other fastener and support 122. The crank 112 for the axle portions is on the same side of the channel as the support 122 around which the paddle wheel 100 is swingable and hingedly connected. The crank 112 is pushed down to raise the paddle wheel 100, instead of the crank being lifted up, as with the paddle wheel 30. Force can be applied to the crank to tilt the paddle wheel, regardless of the side of the channel at which the crank is located with reference to the side of the paddle wheel that is raised. However, for simplicity in operation, by a child, for example, it is easier to understand operation of a crank placed on the side of the channel so that when the crank is lifted, the paddle wheel is lifted, as in FIG. 2, rather than a design where the crank is at the other side as in FIG. 7.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A water activity toy with a paddle wheel, the water activity toy including:

a channel with opposite sides containing a stream of freely floating water;

a respective support at each side of the channel;

a paddle wheel including axially aligned and axially spaced first and second axle portions respectively at the supports at the sides of the channel, the axle portions enabling rotation of the paddle wheel in the supports;

at least a first and a second curved blade extending across the channel and supported on and rotatable with the first and second axle portions, the curved blades being shaped so that as the paddle wheel is rotated, the curved blades dip into the channel and move along the channel to push a water stream through the channel;

each of the blades having a shape between the axle portions so that for at least one orientation of the paddle wheel, with the first and second blades out of the channel, each of the first and second blades is higher above the water in the channel at a location between the axle portions than at the axle portions, which provides taller clearance for an object to pass beneath the curved blade;

said first and second blades being oriented with reference to the axle portions so that the paddle wheel can be rotated to a first position where both the first and second blades then above water in the channel are oriented so that all of the curved blades then above water in the channel are higher above water in the channel at a location between the axle portions than at the axle portions.

2. The toy of claim 1, wherein each of the at least two curved blades has a root or base edge at the axle portions and has an opposite free edge which is rotated deepest through the channel; each of the two curved blades has an axis from the base edge to the free edge, and each of the two curved blades is curved down toward water in said channel around that axis, such that with both of the two curved blades oriented generally horizontally, both of the curved blades are higher above water in the channel away from the axle portions and are lower toward the water at the axle portions.

3. The toy of claim 2, wherein the base edge of each of the curved blades is cut out such that if the blade were oriented to extend generally upward away from water in the channel, the base edge of the blade would be higher above water in the channel away from and between the axle portions than at the axle portions.

4. The toy of claim 1, wherein each of the curved blades has a root or base edge at the axle portions thereof and the base edge of each of the curved blades is cut out such that if the blade were oriented to extend generally upward away from water in the channel, the base edge of the curved blade would be higher above water in the channel away from and between the axle portions than at the axle portions.

5. The toy of claim 1, further comprising means connected with the paddle wheel for rotating the paddle wheel around the axle portions.

6. The toy of claim 5, wherein the means for rotating the paddle wheel comprises a crank connected to one of the axle portions.

7. The toy of claim 5, wherein one of the axle portions is supported in the one respective support enabling the paddle wheel to be swung upward away from and downward toward water in the channel around the one axle portion, and the other axle portion is supported in the other respective support enabling the other axle portion to be lifted free of the other fastener, for permitting the paddle wheel to be swung upward.

8. The toy of claim 7, wherein the means for rotating the paddle wheel comprises a crank connected to the axle portion which is raisable out of the second support.

9. The toy of claim 1 in which the paddle wheel also includes:

a flat blade extending across the channel and supported on and rotatable with the first and second axle portions;

said flat blade being disposed at an angular position midway between said curved blades; and with said paddle wheel in said first position said flat blade being in a vertical plane and extending upward from said axle portions.

10. A water activity toy with a paddle wheel, the water activity toy including:

a channel with opposite sides containing a stream of freely floating water;

a respective support at each side of the channel;

a paddle wheel including axially aligned and axially spaced first and second axle portions respectively at the supports at the sides of the channel, the axle portions enabling rotation of the paddle wheel in the supports;

at least a first and a second blade extending across the channel and supported on and rotatable with the first and second axle portions, the first and second blades being shaped so that as the paddle wheel is rotated, the first and second blades dip into the channel and move along the channel to push a water stream through the channel;

each of the first and second blades having a shape between the axle portions so that for at least one orientation of each of the first and second blades, with the first and second blades out of the channel, each of the first and second blades is higher above the water in the channel at a location between the axle portions than at the axle portions, which provides taller clearance for an object to pass beneath the first and second blades;

said first and second blades being oriented with reference to the axle portions so that the paddle wheel can be rotated to a first position where both the first and second blades are above water in the channel and each of the first and second blades is oriented so that it is higher above water in the channel at a location between the axle portions than at the axle portions.

11. The toy of claim 10 in which the paddle wheel also includes:

a flat blade extending across the channel and supported on and rotatable with the first and second axle portions;

said flat blade being disposed at an angular position midway between said first and second blades; and with said paddle wheel in said first position said flat blade being in a vertical plane and extending upward from said axle portions.

* * * * *